US005238270A

United States Patent [19]

Ozeki

[11] Patent Number: 5,238,270

[45] Date of Patent: Aug. 24, 1993

[54] FILING DEVICE FOR FILING SHEETS HAVING DUST COVERS

[75] Inventor: Jiro Ozeki, Tokyo, Japan

[73] Assignee: Slidex Corporation, Tokyo, Japan

[21] Appl. No.: 851,596

[22] Filed: Mar. 16, 1992

[30] Foreign Application Priority Data

Mar. 20, 1991 [JP] Japan ..... 3-56972

[51] Int. Cl.[5] ..... B42D 3/00

[52] U.S. Cl. ..... 281/48; 40/156

[58] Field of Search ..... 281/48, 45, 51, 21.1; 402/4, 70; 40/156, 157, 158.1, 159, 159.2

[56] References Cited

U.S. PATENT DOCUMENTS

| | | | |
|---|---|---|---|
| 4,128,262 | 12/1978 | Du Corday | 281/48 X |
| 4,351,124 | 9/1982 | Sivertsen et al. | 40/156 X |
| 5,040,671 | 8/1991 | Hager | 40/156 X |
| 5,046,616 | 9/1991 | Makowski et al. | 40/156 X |
| 5,119,574 | 6/1992 | King | 281/21.1 |

*Primary Examiner*—Timothy V. Eley
*Assistant Examiner*—Willmon Fridie, Jr.
*Attorney, Agent, or Firm*—Keck, Mahin & Cate

[57] ABSTRACT

A filing binder comprising a plurality of elongated binding members made of a resilient material. Each of the binding members has a groove extending along the length of the binding member and formed with a slit opening opened at one side of the binding member. The groove is of a cross-sectional configuration which is enlarged from the slit opening toward transverse inward direction. The binding members are arranged in side-by-side relationship with the slit openings directed to the same orientation and connected together by flexible or hinge connection. A file sheet is provided for engagement with the slit opening in the binding member. The file sheet is provided with a dust cover of a transparent material which covers the opposite sides of the file sheet.

25 Claims, 10 Drawing Sheets

FILING DEVICE FOR FILING SHEETS HAVING DUST COVERS

CROSS-REFERENCE TO THE RELATED APPLICATION

The present invention is an improvement of the invention described in the U.S. patent application Ser. No. 545,274 filed on Jun. 28, 1990, now U.S. Pat. No. 5,037,137 issued on Aug. 6, 1991 to Ziro Ozeki who is the applicant of the present application.

BACKGROUND OF THE INVENTION

1. Field of the Invention

The present invention relates to a file device for filing thin sheets of recording medium, such as photographic pictures, slides, medical specimen plates, floppy discs and the like. More particularly, the present invention pertains to a file device for filing file sheets having dust covers.

2. Description of the Prior Art

The Japanese patent application Sho 63-241935 filed on Sep. 27, 1988 and disclosed for public inspection on Mar. 29, 1990 under the disclosure number Hei-02-089699 discloses a file sheet adapted for filing thin recording sheets such a photographic slides. The file sheet is made of a thin plastic sheet formed with recesses adapted for receiving the slides. A plurality of such file sheets are bound in suitable binding covers with photographic slides fitted to the recesses of the sheets or that the slides are filed in a readily accessible manner.

In binding such file sheets, file covers having binding rings provided at appropriate spacings may be used. The file sheets may then be formed along an edge portion with binding holes with spacings equal to the spacings of the binding rings so that the binding rings are fitted to the binding holes in the file sheets. This type of file sheet binding device is advantageous in that the file sheets can be added as desired. It should however be noted that in order to bind an additional file sheet the rings are at first opened and the file sheet is engaged at the binding holes with the rings thus opened. Thereafter, the rings are closed to hold the file sheet together with previously bound file sheets. Thus, binding an additional file sheet requires a troublesome task.

Another problem encountered in the aforementioned sheet binding device is that turning over the file sheets is not convenient. More specifically, in this type of binding device, the binding rings are generally of a large size so that a large number of file sheets can be accommodated. The binding rings of such large size have a tendency of making turning over the file sheets difficult because the file sheet may have a tendency of sticking to the binding rings by being inclined with respect to the row of the binding rings.

In the Japanese utility model application Sho 61-171910 filed on Nov. 11, 1986 and disclosed for public inspection on May 23, 1988 under the disclosure number Sho 63-77782, there is disclosed a filing device for filing file sheets. In this filing device, each film sheet is provided with a dust cover which is in the form of an envelope adapted to cover both sides of the file sheet. As in the file device of the Japanese patent application Sho 63-241935, the file device of the Japanese utility model application is adapted to use a file cover having binding rings. The file sheet is therefore formed along one edge with binding holes for engagement with the binding rings.

The dust cover in the utility model is formed along an edge portion with cutouts which are located at positions corresponding to the positions of the binding holes in the file sheet. The filing device of the utility model has disadvantages which the filing device of the aforementioned Japanese patent application has. Besides, the filing device is disadvantageous in that the cutouts in the dust cover must be aligned with the binding holes in the file sheet before the file sheet is filed in the file cover. In order to take out a recording medium such as a slide film stored in the file sheet, it is necessary to remove the dust cover from the file sheet. For the purpose, the file sheet must be removed from the file cover each time the recording medium is to be taken out.

SUMMARY OF THE INVENTION

It is therefore an object of the present invention to provide a filing device for file sheets in which binding of the file sheets can readily be made so that additional file sheets can be easily filed.

Another object of the present invention is to provide a file device for file sheets which is simple in structure and convenient to use.

A further object of the present invention is to provide a file device which is convenient to change the binding capacity.

Still further object of the present invention is to provide a file device which is compact in size.

Yet further object of the present invention is to provide a filing device for file sheets which have dust covers but are convenient to take out recording medium stored therein.

According to the present invention, the above and other objects can be accomplished by a filing binder comprising a plurality of elongated binding members made of a resilient material, each of the binding members having a groove extending along the length of the binding member and formed with a slit opening opened at one side. The groove is of a cross-sectional configuration which is enlarged from the slit opening toward transverse inward direction. The binding members are arranged in side-by-side relationship with the slit openings directed to the same orientation and connected together by flexible connecting means.

A file sheet is provided for engagement with each binding member. The file sheet has ridge means formed along one edge portion thereof. The file sheet can be filed in filing binder by having the ridge means engaged with the groove of the binding member of the filing binder. The file sheet is provided at each corner portion with a cutout. There is provided for each file sheet a dust cover which may be made of a transparent material. The dust cover is in the form of an envelope for covering both sides of the file sheet and of a size to expose at least the edge portion of the file sheet wherein the ridge means is formed. The dust cover is formed at each corner portion with means for engagement with the file sheet at the cutout.

The binding member may be made of a rigid plastic material and the connecting means may be a weld between adjacent two binding members. The binding member may be formed with the groove having slit openings at the opposite sides. The connecting means may then be one or more connecting members having projections arranged in side-by-side relationship, each of said projections being adapted to be engaged with one of the slit openings in each of the adjacent binding members.

According to another aspect of the present invention, the binding member has a pair of opposed pawls forming a slit opening therebetween. A plurality of such binding members being arranged in side-by-side relationship with the slit openings oriented in the same direction.

According to a further aspect of the present invention, there is also provided a binding member including a plurality sets of holding means each comprising a wall and a holding member made of a resilient material, said holding member having pawl means directed toward the wall to hold a file sheet between said wall and said pawl means, the plurality sets of holding means being connected by resilient connecting means.

The binder comprising the binding members which are connected together as described above may be provided with cover sheets so that the file sheets bound in the binder are covered by the cover sheets.

As described, the present invention provides a binding member which is of an elongated configuration and has a longitudinally extending groove formed with a slit opening opening at one side of the binding member. It will therefore be understood that the file sheet can be held in position simply by having one edge portion engaged with the slit opening of the binding member. The binding members may be connected together with the slit openings oriented to the same direction. In binding the file sheets, it is only required to have one edge portion of each file sheet inserted into the slit opening of the binding member. Thus, binding of the file sheets can be effected through a simple operation. The connecting member for connecting a plurality of the aforementioned binding members can conveniently be used and the binding members can be added as desired depending on the size of the connecting member.

The connecting member comprising a pair of binding members as previously mentioned can be advantageously used because it is possible to bind a desired number of file sheets without being restricted by the size of the connecting member. It should further be noted that the file sheets bound by this connecting member can be accessed very easily.

The dust cover on each file sheet can be removed with the file sheet hold on the binding member. Therefore, it is easy to take out a recording medium stored in the file sheet.

The above and other objects and features of the present invention will become apparent from the following descriptions of preferred embodiments taking reference to the accompanying drawings.

DESCRIPTION OF THE PREFERRED EMBODIMENT

Figure 3:
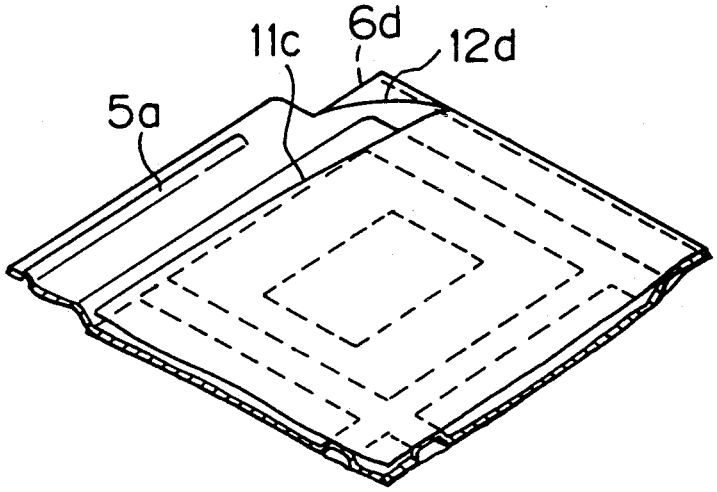
FIG. 3 is a fragmentary perspective view showing the engagement between the file sheet and the dust cover.
Figure 4:
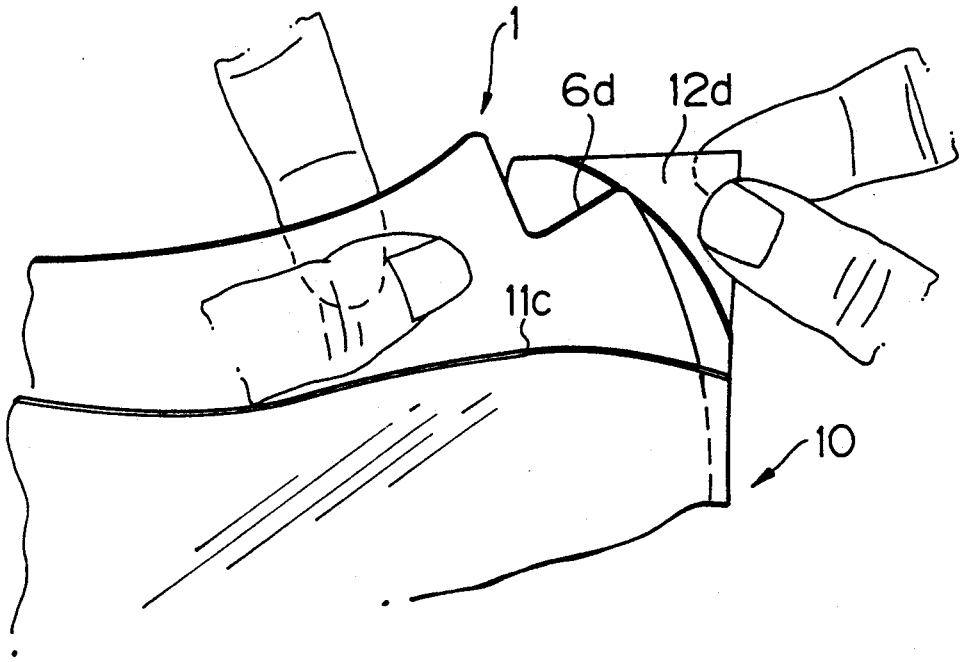
FIG. 4 is a view showing the manner of engaging a corner portion of the dust cover with a corresponding corner portion of the file sheet.
Figure 5:
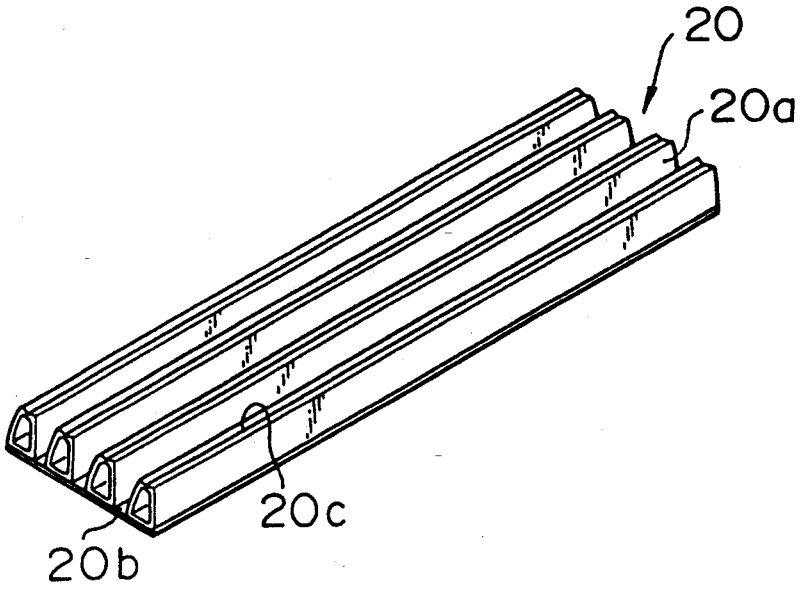
FIG. 5 is a perspective view of a file sheet binder in accordance with one embodiment of the present invention.
Figure 6:
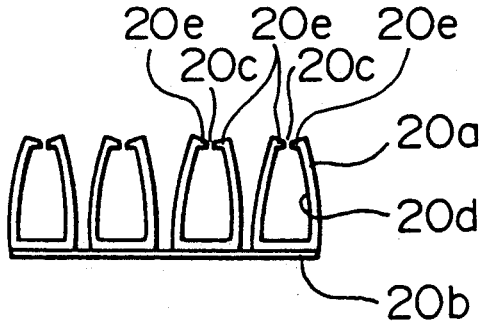
FIG. 6 is an end view of the file sheet binder shown in FIG. 5.

Referring to the drawings, particularly to FIGS. 1 through 8 which show a first embodiment of the present invention, it will be noted in FIGS. 5 and 6 that there is shown a binder 20 comprising a plurality of binding members 20*a*. The binding member 20*a* is made of an extrusion of a solid or hard plastic material and includes a groove 20*d* having a slit opening 20*c* extending along one side of the binding member 20*a*. The groove 20*d* is of a cross-sectional configuration enlarged widthwise toward transversely inward direction. In the illustrated embodiment, four binding members 20*a* are arranged in a side-by-side relationship with the slit openings 20*c* oriented in the same direction. The binding members 20*a* are arranged with spacings corresponding to the thickness of a file sheet to be bound. These binding members 20*a* are connected together at the sides opposite to the slit openings 20*c* by means of a plastic tape 20*b* which is welded to the binding members. The plastic tape 20*b* provides a flexible connection between the binding members 20*a*.

In FIG. 6, it will be noted that the binding member 20*a* is formed at the slit opening 20*c* with a pair of opposed inwardly projecting edges or pawls 20*e*. The slit opening 20*c* is defined between the opposed pair of pawls 20*e*. The pawls 20*e* has outer surfaces which are inclined transversely inwardly to provide guide surfaces for insertion of a file sheet. This guide surfaces makes it convenient to insert the file sheet into the groove 20*d*.

Figure 1:
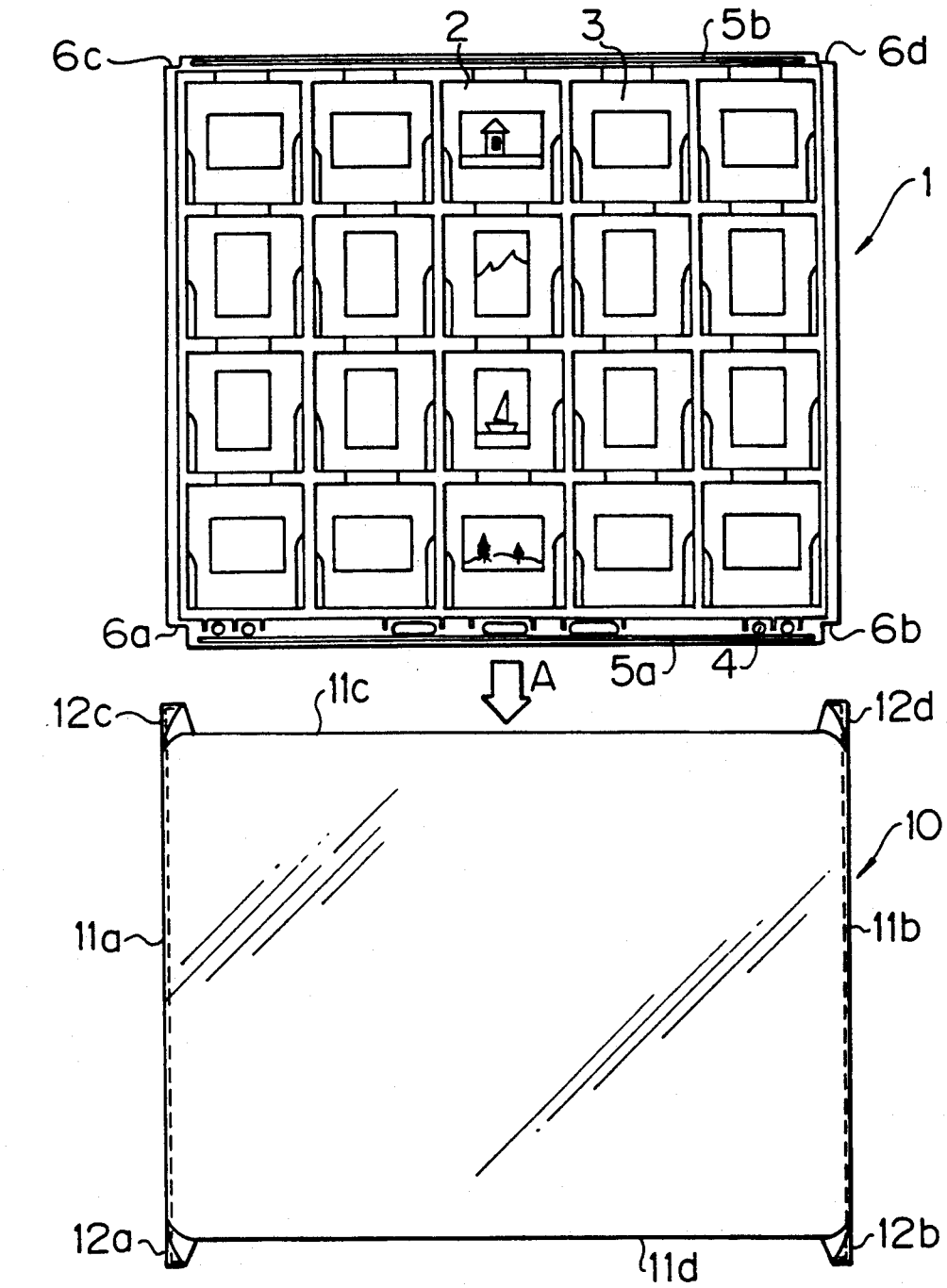
FIG. 1 is a plan view showing a file sheet and a dust cover in accordance with one embodiment of the present invention.

FIG. 1 shows an example of the file sheet 1. In this example, the file sheet 1 has a plurality of sections for accommodating photographic slides 2. Along one edge portion of the file sheet 1, there are formed a plurality of binding holes 4 which are used for engagement with binding rings in a conventional binder which is not shown. Adjacent to the row of the binding holes 4, the file sheet 1 is formed with a ridge 5*a* extending along the aforementioned edge portion of the file sheet 1. In this example, the ridge 5a is of a single continuous structure, however, a plurality of ridges may be formed to extend in a single row. Along the edge portion of the file sheet 1 opposite to the edge portion wherein the ridge 5a and the binding holes 4 are formed, there is formed a ridge 5b which is similar to the ridge 5a.

The file sheet 1 is formed at respective corner portions with substantially rectangular cutouts 6a, 6b, 6c and 6d. The cutouts 6a and 6b are formed at the opposite ends of the edge portion wherein the ridge 5a and the binding holes 4 are formed. The cutouts 6a and 6b extend transversely inwardly beyond a line along which the binding holes 4 are formed. The cutouts 6c and 6d are formed at the opposite ends opf the edge portion where the ridge 5b is formed. The cutouts 6c and 6d extend transversely inwardly beyond a line along which the ridge 5b is formed.

FIG. 1 further shows a dust cover 10. The dust cover 10 is made of a transparent film material and in the form of an envelope having opposite sheets which cover the opposite sides of the file sheet 1. The envelope forming the dust cover 10 has opposite edge portions 11a and 11b where the sheets of the dust cover are connected together. The sheets of the dust cover are not connected together at other edge portions 11c and 11d so that the envelope is opened at these edge portions 11c and 11d. The file sheet 1 can therefore be inserted into the envelope of the dust cover through the opening at the edge portion 11c or 11d as shown by an arrow A in FIG. 1.

Figure 2:
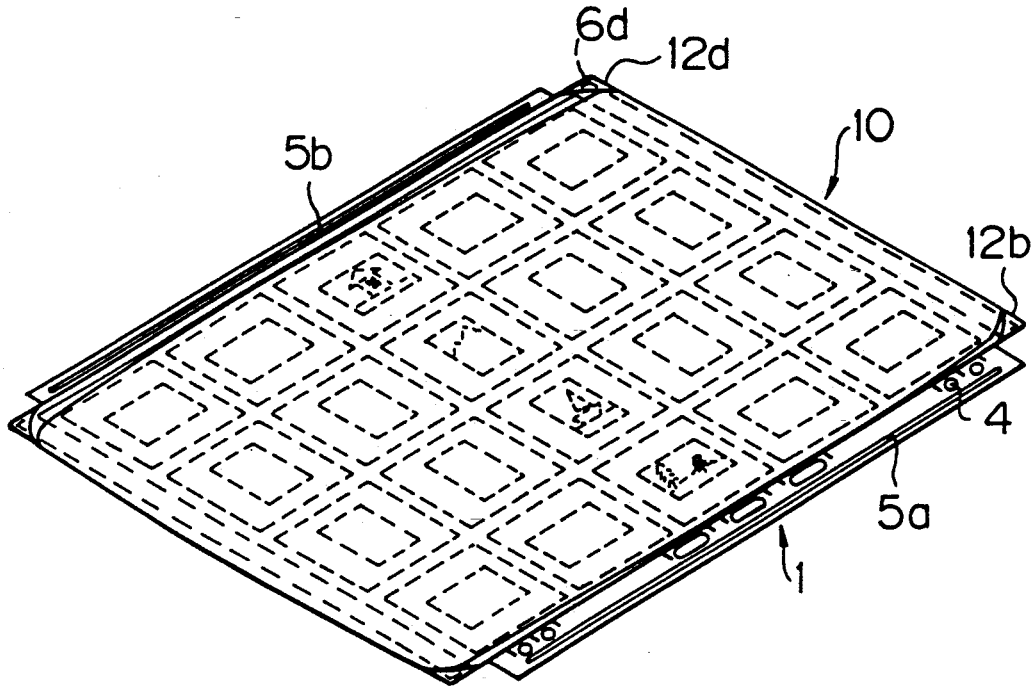
FIG. 2 is a perspective view of the file sheet shown in FIG. 1 with the dust cover placed on the file sheet.

It will be noted in FIG. 1 that the dust cover 10 is formed at respective corner portions with hooking straps 12a, 12b, 12c and 12d for engagement with the respective cutouts 6a, 6b, 6c and 6d in the file sheet 1. After the file sheet 1 is inserted into the envelope of the dust cover 10, the straps 12a, 12b, 12c and 12d are engaged with respective ones of the cutouts 6a, 6b, 6c and 6d as shown in FIGS. 3 and 4 so that the dust cover 10 is firmly held on the file sheet 1. In this position, the edge portions having the ridges 5a and 5b are exposed from the dust cover 10 as shown in FIG. 2.

Figure 7:
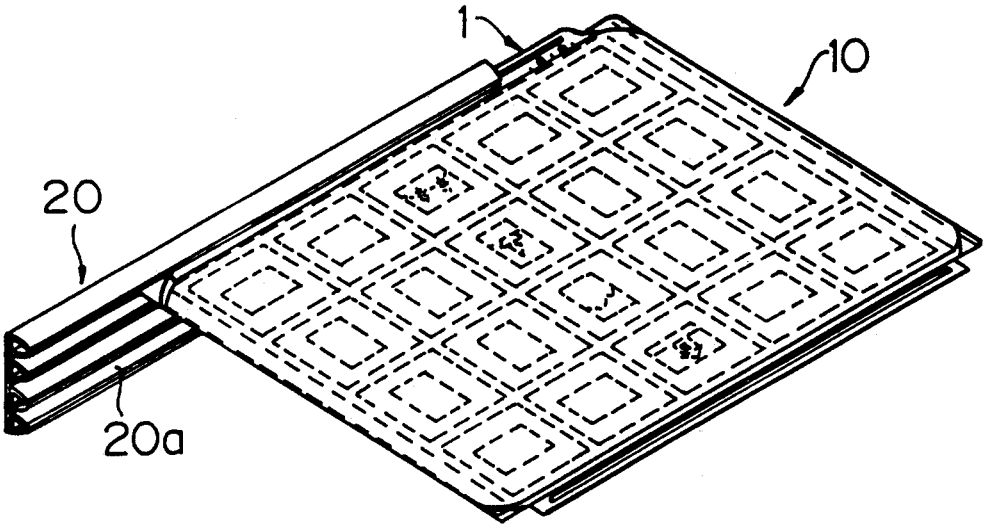
FIG. 7 is a perspective view showing the manner wherein the file sheet shown in FIG. 2 is being engaged with the binder shown in FIG. 5.
Figure 8:
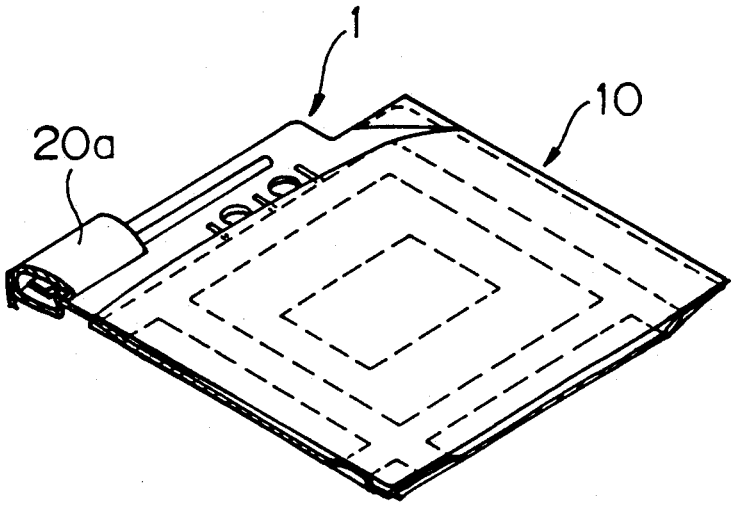
FIG. 8 is a fragmentary perspective view showing the engagement between the file sheet and the binder.

The file sheet 1 with the dust cover 10 shown in FIG. 1 can be held in position in the binder 20 by having the ridge 5a or 5b engaged with the groove 20d of the binding member 20a. In this position, the ridge 5a or 5b is engaged with the inner face of one of the pawl 20e forming the slit opening 20c. FIGS. 7 and 8 show the file sheets 1 with the dust cover 10 thereon held in the binder 20.

Cover sheets (not shown) may be engaged with the outermost ones of the binding members 20a of the binder 20 and the file sheets 1 may be held by intermediate ones of the binding members 20a. The cover sheets may not be necessary. The number of the binding members 20a can be increased as desried. For example, two binders 20 having four binding members 20a may be connected together by means of an adhesive tape. Alternatively, the number of the binding members 20a may be determined as desired when they are welded together by the plastic tape 20b.

Figure 9:
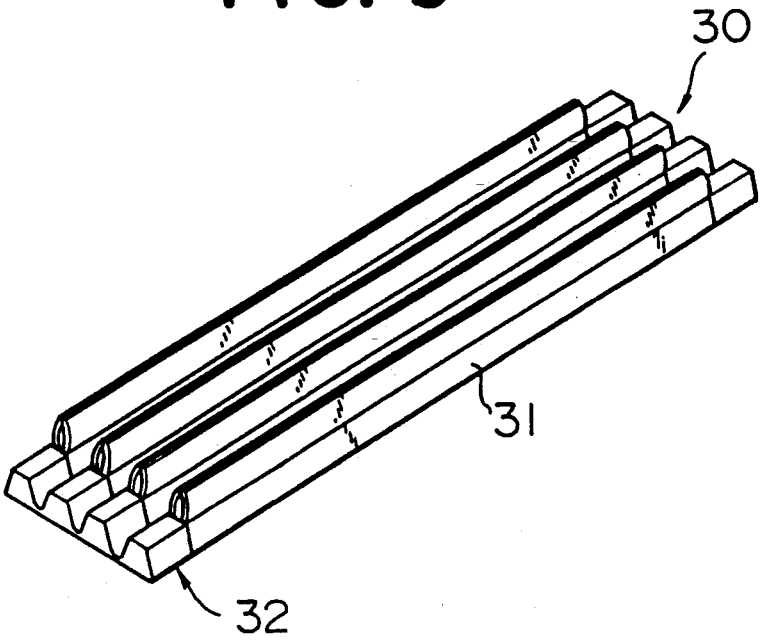
FIG. 9 is a perspective view of a file sheet binder in accordance with another embodiment of the present invention.
Figure 10:
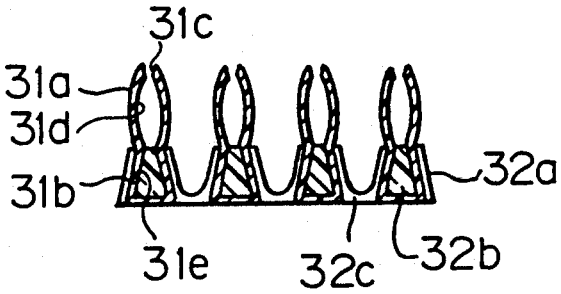
FIG. 10 is a cross-sectional view of the binder shown in FIG. 9.
Figure 11:
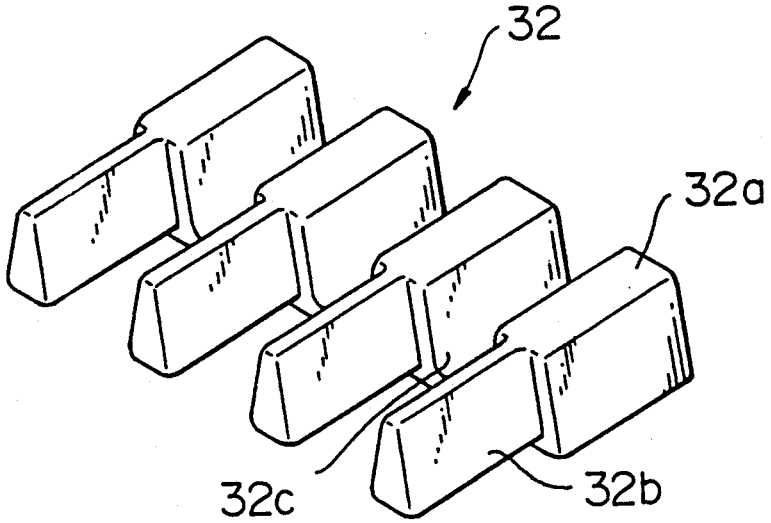
FIG. 11 is a perspective view of a connecting member used in the binder shown in FIG. 9.

Referring now to FIGS. 9 to 11, there is shown another embodiment of the binder 30. In this embodiment, the binder 30 includes a plurality of binding members 31 which are made of extrusions of a solid plastic material. The binding member 31 includes a pair of opposed binding pieces 31a of annular cross-sectional shape and a base portion 31b continuous with the binding sections 31a. The binding sections 31a are arranged to define a groove 31d having a slit opening 31c. The groove 31d is of a cross-sectional configuration enlarged toward transverse inward direction from the slit opening 31c. The slit opening 31c is defined by edges of the opposed binding sections 31a. In the base portion 31b, there is formed a groove 31e of a trapezoidal cross-sectional configuration.

The binding members 31 are connected together by means of connecting members 32. The connecting member 32 includes a plurality of bodies 32a and projections 32b extending from respective ones of the bodies 32a. The bodies 32a and the projections 32b are made integrally from a plastic material. The projection 32b has a cross-sectional configuration corresponding to the cross-sectional configuration of the groove 31e of the binding member 31. As shown in FIG. 10, the bodies 32a are connected together by means of flexible connecting bands 32c. The binding members 31 are connected together by the connecting member 32 by having the projections 32b of the connecting member 32 engaged with the grooves 31d of the binding members 31. As shown in FIG. 9, the binding members 31 are connected together at the opposite end portions by two connecting members 32.

Figure 12:
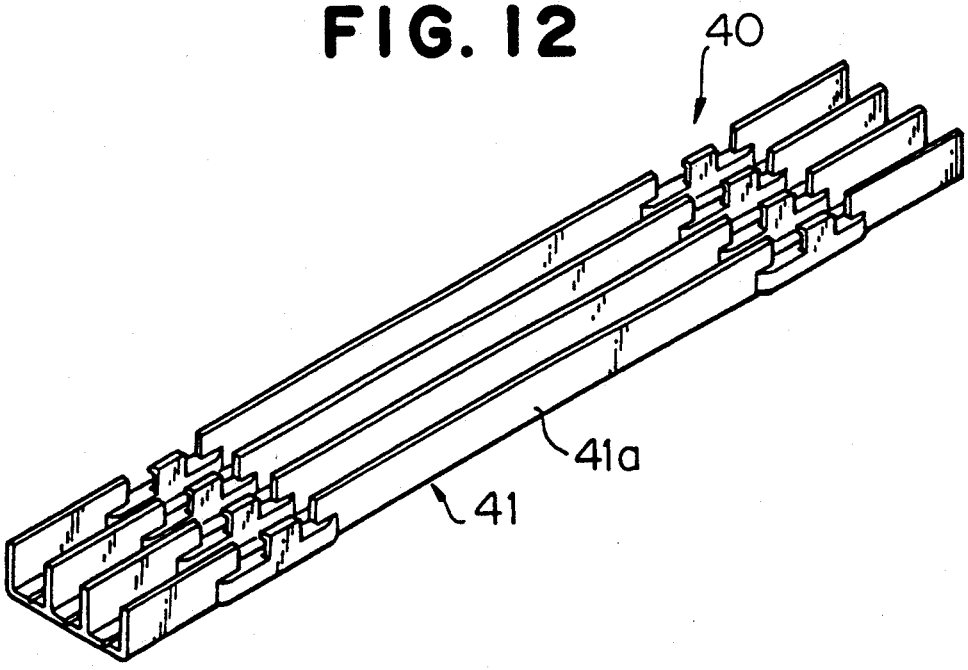
FIG. 12 is a perspective view of a file sheet binder in accordance with a further embodiment of the present invention.
Figure 13:
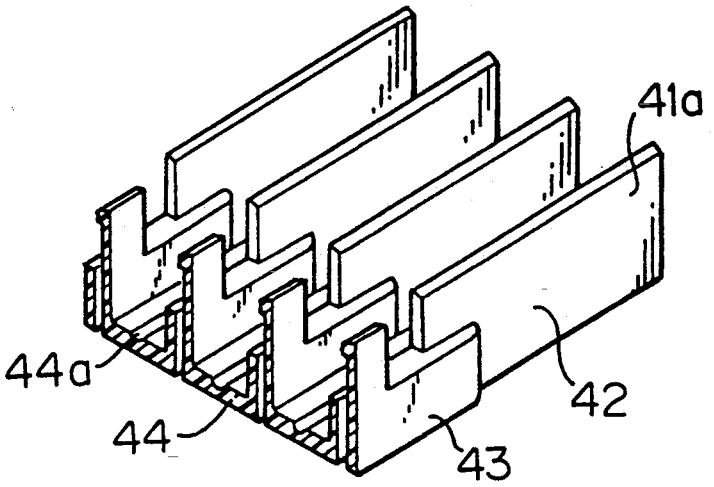
FIG. 13 is a fragmentary perspective view showing the detail of the file binder shown in FIG. 12.
Figure 14:
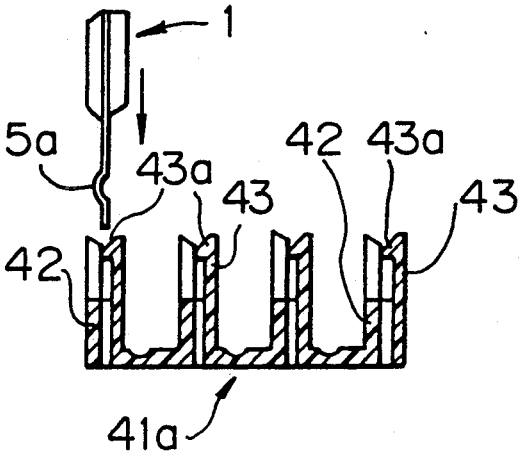
FIG. 14 is a cross-sectional view of the binder shown in FIG. 12.

FIGS. 12 through 14 show a further embodiment of the binder. In this embodiment, the binder 40 is constituted by a plurality of binding members 41a which are connected together. Each of the binding members 41a includes a wall 42 and a binding section 43 provided at a sidewardly offset position with respect to the wall 42. The wall 42 and the binding section 43 are connected together by a base 44 as shown in FIG. 13. The base 44 is formed with a groove 44a which provides a flexibility to the base 44. The binding section 43 has a pawl 43a which is directed opposite to the wall 42. The binding members 41 are connected together by welding the bottom portion of the binding section 43 to the wall 42 of the adjacent binding member 41 with the pawl 43a of the binding section 43 directed to the wall 42 of the adjacent binding member 41. As shown in FIG. 14, a file sheet 1 having a ridge 5a at one edge portion is inserted between the wall 42 of one binding member 41 and the binding section 43 of the adjacent binding member 41. The ridge 5a of the file sheet 1 is then gripped in position by the pawl 43a of the binding section 43.

Figure 15:
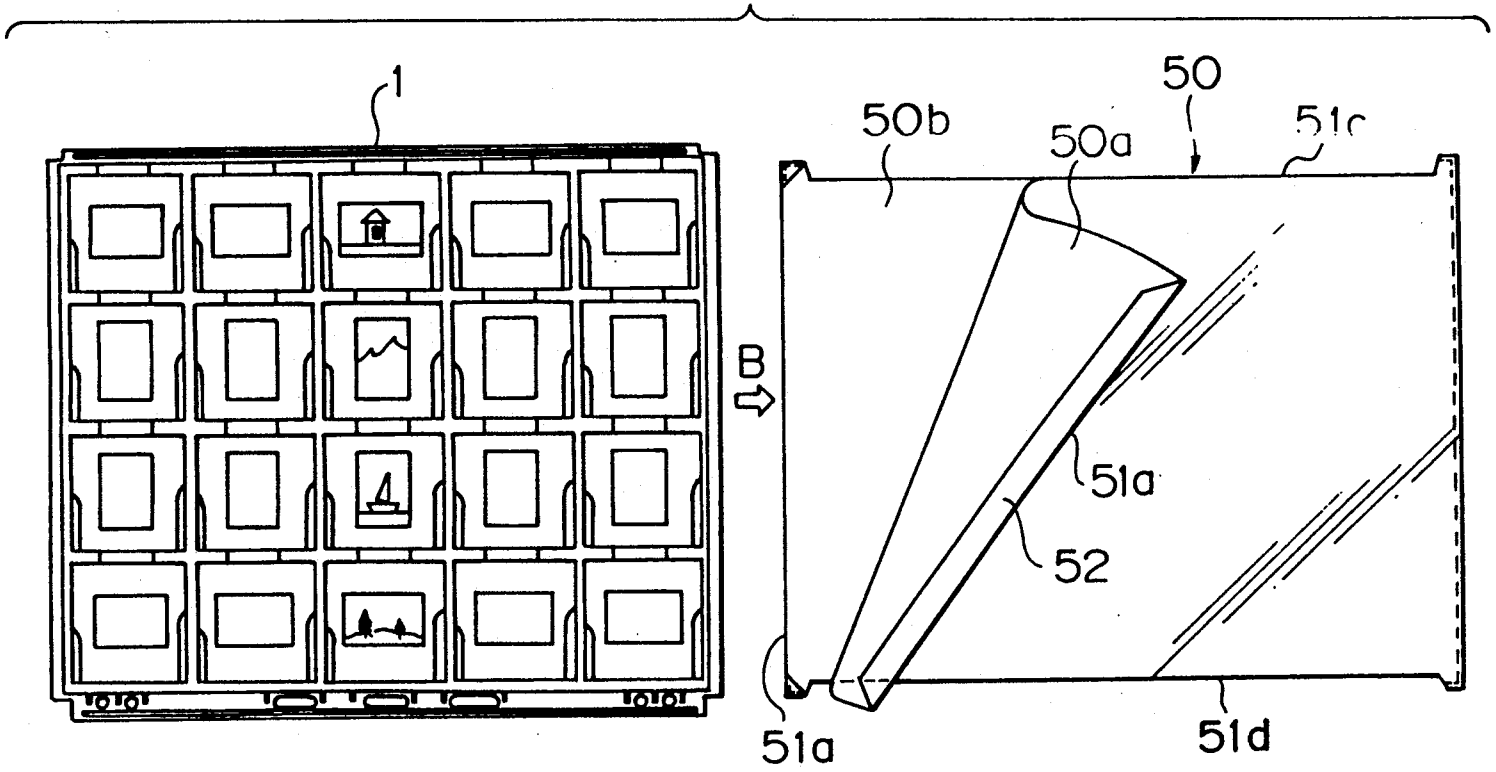
FIG. 15 is a perspective view of a file sheet and a dust cover in accordance with another embodiment of the present invention.

Referring to FIG. 15, there is shown another embodiment of the dust cover. In this embodiment, the dust cover 50 is similar in structure to the dust cover shown in FIG. 1 except that the opposite sheets 50a and 50b of the dust cover 50 are not connected together at the edge portion 51a. The top sheet 50a is bent at the edge portion 51a to form a folded portion 52. The file sheet 1 is inserted into the dust cover 50 with the top sheet 50a peeled from the bottom sheet 50b at the edge portion 51a. Then, the top sheet 50a is placed on the top surface of the file sheet 1 and the folded portion 52 is engaged with the adjacent edge of the bottom sheet 50b.

Figure 16:
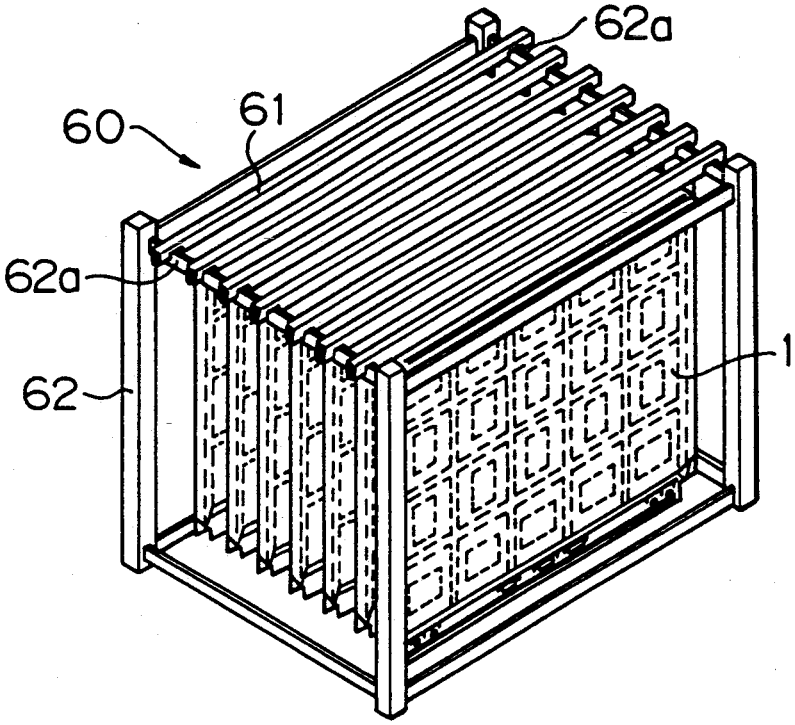
FIG. 16 is a perspective view showing a file sheet hanging device.
Figure 17:
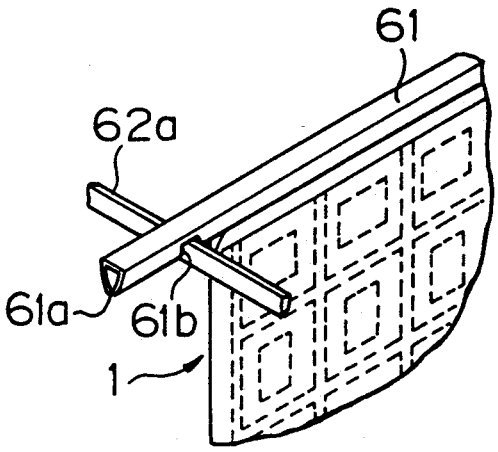
FIG. 17 is a fragmentary perspective view showing the detail of the file sheet hanging device.

Referring now to FIGS. 16 and 17, there is shown a file sheet hanging device 60. The device 60 includes a frame 62 for hanging binding members 61 holding file sheets 1. The binding members 61 are similar to the binding members 20a in the embodiment shown in FIGS. 1 and 2 and have slit openings 61a where the file sheets 1 are engaged. The binding member 61 is formed at a portion adjacent to each end portion with a cutout 61b. The frame 62 has hanging members 62a which are adapted to be engaged with the respective ones of the cutouts 61b in the binding members 61. Thus, the binding members 61 carrying the file sheets 1 are hung on the frame 62 as shown in FIG. 16.

From the above description, it will be understood that the present invention provides a filing device in which file sheets can readily be filed or removed. The binding member of the present invention allows to determine the capacity of the file as desired by adding or removing the binding member. Thus, the present invention provides a simple and compact file device.

The invention has thus been shown and described with reference to specific structures, however, it should be noted that the invention is in no way limited to the details of the illustrated structures but changes and modifications may be made without departing from the scope of the appended claims.

I claim:

1. A combination of a file binder with at least one file sheet having opposite surfaces and a dust cover having first and second sheet portions respectively covering said opposite surfaces of said file sheet, said binder comprising a plurality of elongated binding members made of a resilient material, each of said binding members having a groove extending along the length of the binding member and formed with a slit opening opened at one side of the binding member, said groove being of a cross-sectional configuration which is enlarged from said slit opening toward transverse inward direction, said binding members being arranged in side-by-side relationship with said slit openings directed to the same orientation and connected together by flexible connecting means, said file sheet having ridge means formed along at least one edge portion of said file sheet, whereby said file sheet can be filed in said binder by having said ridge means engaged with said groove of at least one of said binding member, said file sheet being of a substantially rectangular configuration having corner portions and formed with a cutout in each of said corner portions, said sheet portions in said dust cover being of a size to expose said ridge means in said edge portion of said file sheet, said dust cover having corner portions, each being provided with means for engagement with said file sheet at said corner cutout.

2. The combination in accordance with claim 1 in which said dust cover is of a transparent material.

3. The combination in accordance with claim 1 in which said engagement means is in the form of a strap for engagement with an edge portion of said file sheet at said corner portion of said file sheet.

4. The combination in accordance with claim 1 wherein said dust cover is in the form of an envelope in which said first and second sheet portions are connected at the opposite side edge portions.

5. The combination in accordance with claim 1 wherein said dust cover is in the form of an envelope in which said first and second sheet portions are connected at one side edge portion, one of said first and second sheet portions being provided at the side edge portion opposite to said one side edge portion with means for detachably engaging with the other of said first and second sheet portions.

6. A combination of a file binder with at least one file sheet having opposite surfaces and a dust cover having first and second sheet portions respectively covering said opposite surfaces of said file sheet, said binder comprising a plurality of elongated binding members having a groove extending along the length of the binding member and formed with a slit opening opened at one side of the binding member, said groove being of a cross-sectional configuration which is enlarged from said slit opening toward transverse inward direction, said binding member being opened at the longitudinally opposite ends, said binding members being in side-by-side relationship with said slit openings directed to the same orientation and connected together by connecting means having a plurality of projections which are engaged with said grooves at the opposite ends of said binding members, said file sheet having ridge means formed along at least one edge portion of said file sheet, whereby said file sheet can be filed in said binder by having said ridge means engaged with said groove of at least one of said binding member, said file sheet being of a substantially rectangular configuration having corner portions and formed with a cutout in each of said corner portions, said sheet portions in said dust cover being of a size to expose said ridge means in said edge portion of said file sheet, said dust cover having corner portions, each being provided with means for engagement with said file sheet at said corner cutout.

7. A combination of a file binder with at least one file sheet having opposite surfaces and a dust cover having first and second sheet portions respectively covering said opposite surfaces of said file sheet, said binder comprising a plurality of elongated binding members, each including a longitudinally extending wall and a binding section having a pawl directed toward said wall to define a slit opening, said binding members being arranged with said slit openings oriented in the same direction, said file sheet having ridge means formed along at least one edge portion of said file sheet, whereby said file sheet can be filed in said binder by having said ridge means engaged with said groove of at least one of said binding member, said file sheet being of a substantially rectangular configuration having corner portions and formed with a cutout in each of said corner portions, said sheet portions in said dust cover being of a size to expose said ridge means in said edge portion of said file sheet, said dust cover having corner portions, each being provided with means for engagement with said file sheet at said corner cutout.

8. The combination in accordance with claim 6 in which said dust cover is of a transparent material.

9. The combination in accordance with claim 6 in which said engagement means is in the form of a strap for engagement with an edge portion of said file sheet at said corner portion of said file sheet.

10. The combination in accordance with claim 6 wherein said dust cover is in the form of an envelope in which said first and second sheet portions are connected at the opposite side edge portions.

11. The combination in accordance with claim 6 wherein said dust cover is in the form of an envelope in which said first and second sheet portions are connected at one side edge portion, one of said first and second sheet portions being provided at the side edge portion opposite to said one side edge portion with means for detachably engaging with the other of said first and second sheet portions.

12. The combination in accordance with claim 7 in which said dust cover is of a transparent material.

13. The combination in accordance with claim 7 in which said engagement means is in the form of a strap for engagement with an edge portion of said file sheet at said corner portion of said file sheet.

14. The combination in accordance with claim 7 wherein said dust cover is in the form of an envelope in which said first and second sheet portions are connected at the opposite side edge portions.

15. The combination in accordance with claim 7 wherein said dust cover is in the form of an envelope in which said first and second sheet portions are connected at one side edge portion, one of said first and second sheet portions being provided at the side edge portion opposite to said one side edge portion with means for detachably engaging with the other of said first and second sheet portions.

16. A combination of a file binder and at least one file sheet having opposite surfaces and a dust cover having first and second sheet portions respectively covering said opposite surfaces of said file sheet, said binder comprising a plurality of binding members made of a resilient material each being of an elongated configuration and having a pair of opposed, inwardly directed edges which define a slit opening between said edges, said binding members being connected together by flexible connecting means with said slit openings oriented in the same direction, said file sheet having ridge means formed along at least one edge portion of said file sheet, whereby said file sheet can be filed in said binder by having said ridge means engaged with said slit opening of at least one of said binding member, said file sheet being of a substantially rectangular configuration having corner portions and formed with a cutout in each of said corner portions, said sheet portions in said dust cover being of a size to expose said ridge means in said edge portion of said file sheet, said dust cover having corner portions, each being provided with means for engagement with said file sheet at said corner cutout.

17. The combination in accordance with claim 16 in which said dust cover is of a transparent material.

18. The combination in accordance with claim 16 in which said engagement means is in the form of a strap for engagement with an edge portion of said file sheet at said corner portion of said file sheet.

19. The combination in accordance with claim 16 wherein said dust cover is in the form of an envelope in which said first and second sheet portions are connected at the opposite side edge portions.

20. The combination in accordance with claim 16 wherein said dust cover is in the form of an envelope in which said first and second sheet portions are connected at one side edge portion, one of said first and second sheet portions being provided at the side edge portion opposite to said one side edge portion with means for detachably engaging with the other of said first and second sheet portions.

21. A combination of a file sheet having opposite surfaces and a dust cover having first and second sheet portions respectively covering said opposite surfaces of said file sheet, said file sheet having ridge means formed along at least one edge portion of said file sheet, said file sheet being of a substantially rectangular configuration having corner portions and formed with a cutout in each of said corner portions, said sheet portions in said dust cover being of a size to expose said ridge means in said edge portion of said file sheet, said dust cover having corner portions, each being provided with means for engagement with said file sheet at said corner cutout.

22. The combination in accordance with claim 21 in which said dust cover is of a transparent material.

23. The combination in accordance with claim 21 in which said engagement means is in the form of a strap for engagement with an edge portion of said file sheet at said corner portion of said file sheet.

24. The combination in accordance with claim 21 wherein said dust cover is in the form of an envelope in which said first and second sheet portions are connected at the opposite side edge portions.

25. The combination in accordance with claim 21 wherein said dust cover is in the form of an envelope in which said first and second sheet portions are connected at one side edge portion, one of said first and second sheet portions being provided at the side edge portion opposite to said one side edge portion with means for detachably engaging with the other of said first and second sheet portions. with means for detachably engaging with the other of said first and second sheet portions.

* * * * *